United States Patent [19]

Kobayashi et al.

[11] 4,226,158

[45] Oct. 7, 1980

[54] DAMPER ASSEMBLY FOR KEYBOARD MUSICAL INSTRUMENTS

[75] Inventors: Eiji Kobayashi; Hiroyoshi Takahashi, both of Hamamatsu, Japan

[73] Assignee: Nippon Gakki Seizo Kabushiki Kaisha, Japan

[21] Appl. No.: 376

[22] Filed: Dec. 29, 1978

[30] Foreign Application Priority Data

Jan. 14, 1978 [JP] Japan ..... 53/3027[U]
Jan. 14, 1978 [JP] Japan ..... 53/3028[U]

[51] Int. Cl.[3] ..... G10C 3/16

[52] U.S. Cl. ..... 84/239; 84/217; 84/255

[58] Field of Search ..... 84/216–218, 84/236–239, 243, 255

[56] References Cited

U.S. PATENT DOCUMENTS

| | | | |
|---|---|---|---|
| 900,308 | 10/1908 | Perry | 84/236 |
| 1,803,890 | 5/1931 | Campbell et al. | 84/239 |

FOREIGN PATENT DOCUMENTS

| | | | |
|---|---|---|---|
| 187286 | 7/1907 | Fed. Rep. of Germany | 84/237 |
| 429410 | 5/1926 | Fed. Rep. of Germany | 84/236 |

*Primary Examiner*—Lawrence R. Franklin
*Attorney, Agent, or Firm*—Ostrolenk, Faber, Gerb & Soffen

[57] ABSTRACT

In the construction of a damper assembly for musical instruments, the conventionally used swingable damper lever for operationally relating a key to an associated damper wire is omitted and the swing movement of the key is either directly and indirectly converted into a corresponding fairly vertical movement of an elongated damper holder via a balance weight disposed to the bottom end of the damper holder in order to avoid undesired influences caused by swinging movement of any mechanical parts. Use of a plate type damper holder further advantageously prevents undesirable twist and dancing of the damper holder. Simultaneous, even and well-controlled pressure contact of the damper head with the vibrating string assures ideal damping and acoustic effects and use of detachable balance weight enables free adjustment of touch on the key.

6 Claims, 6 Drawing Figures

DAMPER ASSEMBLY FOR KEYBOARD MUSICAL INSTRUMENTS

BACKGROUND OF THE INVENTION

The present invention relates to an improved damper assembly for keyboard musical instruments, such as a piano in which free vibration of each string is usually restrained through pressure contact with an associated damper head and, only when an associated key is depressed, the damper head is brought out of the pressure contact with the string in order to allow free vibration of the string for generation of a corresponding musical tone.

In the construction of the conventional damper assembly, swinging movement of a key caused by its depression is transmitted to an associated damper wire holding a damper head by means of a swingable damper lever. Swinging movement of the damper lever tends to cause deviation of the damper wire from the true verticality in movement and dancing of the damper wire during the movement. Such deviation from the true verticality in movement often leads to time variations and uneven contact of the entire damper head with the vibrating string, thereby seriously degrading the damping and acoustic effects. Dancing during the movement promotes frictional abrasion on the damper wire and a guide rail for the damper wire, which finally causes uncontrolled contact of the damper head with the vibrating string, thereby degrading the damping and acoustic effects also. Use of a damper wire that is circular in cross section causes easy axial twisting of the damper wire when the damper head held by the damper wire contacts the string vibrating in a conical ambit and this results in biased contact of the damper head with the string, thereby further lowering the damping and acoustic effects. Balance weights are embedded in one body in the damper lever in order to provide a proper weight to the damper assembly. This embedded construction of the balance weights disables easy replacement of the balance weight for adjustment of touch on the key. Further, forced embedding of the balance weight often causes accidental breakage of the damper lever due to development of cracks.

SUMMARY OF THE INVENTION

It is the basic object of the present invention to provide a damper assembly which affords beautifully enhanced damping and acoustic effects.

It is another object of the present invention to provide a damper assembly which successfully avoids adverse influence be caused by swingable movement of any mechanical part and assures simultaneous and even contact of the damper head with the vibrating string.

It is another object of the present invention to provide a damper assembly which prevents undesirable dancing of the damper holder during its movement and enables well controlled contact of the damper head with the vibrating string.

It is a further object of the present invention to provide a damper assembly which allows easy replacement of the balance weight and enables free adjustment of the touch on the associated key.

It is a yet further object of the present invention to provide a damper assembly which eliminates undesirable twisting of the damper holder upon contact of the damper head with the vibrating string, thereby enabling ideally aligned contact of the damper head with the string.

In accordance with the basic aspect of the present invention, the conventionally used swingable damper lever is omited in the construction of the damper assembly.

Thus, in one specified aspect of the present invention, a vertically elongated damper holder extends idly through a fixed guide block and is movable in a vertical direction when it is thrust up by an associated operated key. A balance weight may be detachably coupled to the bottom end of the damper holder. Preferably, the damper holder has the form of a strip.

In another specified aspect of the present invention, a vertically elongated damper holder extends idly through a fixed guide block and is movable in a vertical direction. A vertical rod slidably held by a guide rail is located below the bottom end of the damper holder. This rod has an upper thrust piece facing the bottom end of the damper holder and a lower seat piece resting on the rear end of a key.

DESCRIPTION OF THE PREFERRED EMBODIMENTS

In the following description, the side and parts of the damper assembly close to the keyboard of the musical instrument will be referred to with expressions such as "front" and "fore" whereas the side and parts of the assembly remote from the keyboard will be referred to with expressions such as "back" and "rear".

Figure 1:
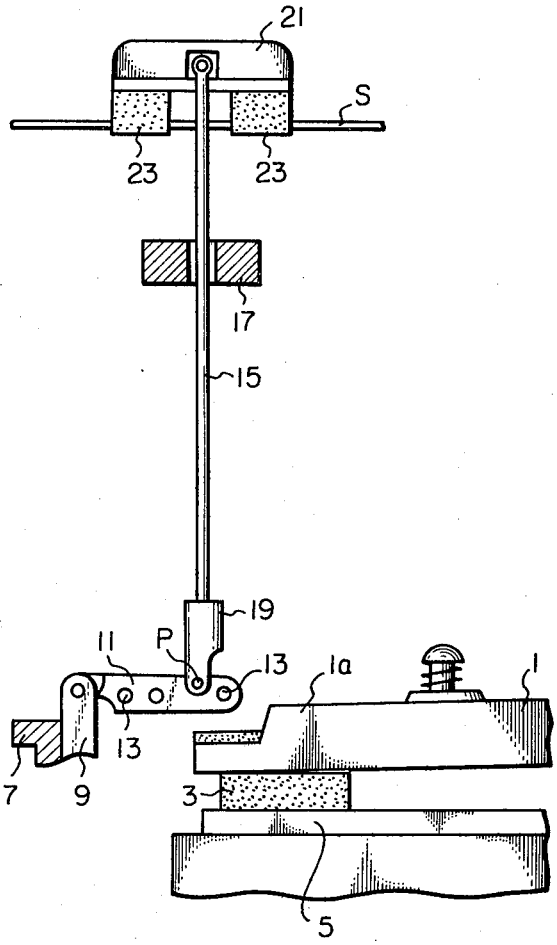
Fig. 1 PRIOR ART
FIG. 1 is a side view, partly in section, of a typical example of the conventional damper assembly.

One typical example of the conventional damper assembly usable for a grand-type piano is shown in FIG. 1, in which the damper assembly is arranged above and behind the rear end portion 1*a* of each key 1. When the key 1 is not depressed, the rear end portion 1*a* of key 1 rests on a back rail cloth 3 placed on the key frame 5. A damper lever rail 7 extending over the entire width of the keyboard is fixedly arranged behind the rear end of the key 1 and a damper lever flange 9 is fixed to the front face of the damper lever rail 7. A damper lever 11 is pivoted at the rear end to the damper lever flange 9 and is provided with several balance weights 13 which are made of a heavy metal such as lead and are fixedly embedded in the body of the damper lever 11.

A damper wire 15 extends vertically up from lever 11 and idly passing through a damper guide rail 17 which extends over the entire width of the keyboard. The bottom end of the damper wire 15 is coupled at a pivot P to the front end of the damper lever 11 by means of a damper block 19. At a position somewhat above a string S, the damper wire 15 fixedly carries a damper head comprised of a damper block of wood 21 and damper felts 23 attached to the bottom of the damper block of wood 21. The bottom faces of the damper felts 23 face the associated string S.

When the key 1 is not depressed, the damper felts 23 are brought into pressure contact with the associated string S due to the weight of the damper assembly and restrain vibration of the string S thereby allowing no generation of a musical tone. As the key 1 is depressed during performance of the musical instrument, the rear end portion 1*a* of the key 1 swings upwards and thrusts up the front end of the damper lever 11 overcoming the above-described weight of the damper assembly so that the damper lever 11 swings upwards about its rear pivot. This swing of the damper lever 11 thrusts up the damper wire 15 together with the damper block of wood 21. Thus, the damper felts 23 are placed out of pressure contact with the string S which is now ready for free vibration. Depression on the key 1 concurrently actuates an associated hammer (not shown) which thereupon strikes the string S for generation of a musical tone. As the pressure on the key 1 is halted, the end portion 1*a* of the key 1 resumes its original state shown in the drawing and the damper wire 15 automatically lowers due to the weight of the damper assembly. The damper felts 23 are again brought into pressure contact with the string S in order to hamper further free vibration of same.

As hereinbefore mentioned briefly, the conventional damper assembly of the above-described type has several drawbacks.

When thrust up by the rear end portion 1*a* of the key 1, the front end of the damper lever 11 swings about the rear pivot on the damper lever flange 9 and, therefore, the pivot P moves along an arcuate locus. Due to this arcuate movement of the pivot P, the associated movement of the damper wire 15 more or less deviates from true verticality. This deviated movement of the damper wire 15 tends to disturb simultaneous and even contact of the damper head with the string S over the entire effective length of the damper head especially when the damper wire 15 lowers. Such nonsimultaneous and uneven contact of the entire damper head with the string naturally ends in degraded damping and acoustic effects.

The above-described deviated movement of the damper wire 15 induces dancing of the damper wire 15 during the movement. The damper wire 15 extends idly through the damper guide rail 17. Therefore, dancing of the damper wire 15 causes frictional abrasion of both the damper wire 15 and the damper guide rail 17. Such abrasion on the cooperating parts amplifies the dancing of the guide wire 15 which results in further uncontrolled contact of the damper head with the string S.

The damper wire 15 is generally in the form of a relatively thin rod having a circular transverse cross section. It therefore, is liable to twist about its axis in the peripheral direction when any external force causing such a twist is applied thereto. When the string S is struck by the hammer (not shown), it vibrates within a conical ambit around its normal running course in the stationary state.

At the moment when the damper felts 23 comes in contact with the string S vibrating in the above-described fashion, a force acts on the damper wire 15 via the damper head to twist the damper wire 15 about its axis. This twist of the damper wire 15 naturally causes the longitudinal axis of its normal damper head to deviate from the running course in the direction of the string S. This deviation in contact of the damper head with the string S results in insufficient contact pressure on the vibrating string S thereby seriously degrading the damping and acoustic effects.

The balance weights 13 are embedded in the body of the damper lever 11 in order to adjust the weight of the damper assembly, i.e. touch on the key 1 and to provide sufficient damping effect on the vibrating string S. More particularly, the balance weights 13 are forcibly inserted into through holes formed in the body of the damper lever 11. The fixed attachment of the balance weights 13 to the damper lever 11 disables easy and frequent adjustment of the own weight of the damper assembly. Further, too forcible insertion of the balance weights 13 tends to cause development of cracks in the body of the damper lever 11. On the contrary, too loose insertion of the balance weights 13 may result in their too easily separating from the damper lever or in generation of undesirable noises caused by dancing of the balance weights 13 in the associated holes.

For each key 1, it is necessary to provide a set comprised of damper lever 11 and a damper lever flange 9 in order to couple the damper lever 11 to the common damper lever rail 7. Thus, this construction requires an increased number of mechanical parts, which leads to greater maintainance trouble, complicated parts control and increased work in parts assemblage.

Figure 2:
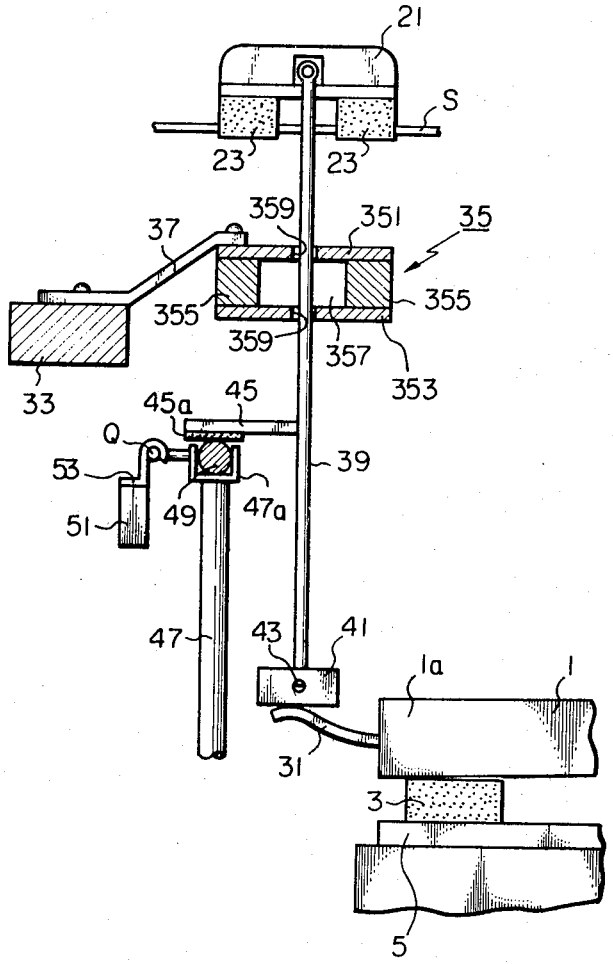
FIG. 2 is a side view, partly in section, of one embodiment of the damper assembly in accordance with the present invention.

The first embodiment of the damper assembly in accordance with the present invention is depicted in FIG. 2, in which mechanical parts that are substantially similar in construction and operation to those used in the prior art shown in FIG. 1 are designated with similar reference symbols.

The key 1 used for this embodiment is provided with a damper spoon 31 extending rearwards and somewhat upwards from the rear end thereof. A damper guide rail 33 in this embodiment is fixedly arranged above and somewhat behind the rear end portion 1*a* of the key 1 and, like the damper guide rail 17 used in the prior art, extends over the entire width of the keyboard. On the front side of the damper guide rail 33, a damper guide block 35 is fixedly supported by the damper guide rail 33 by means of an arm 37.

Figure 4:
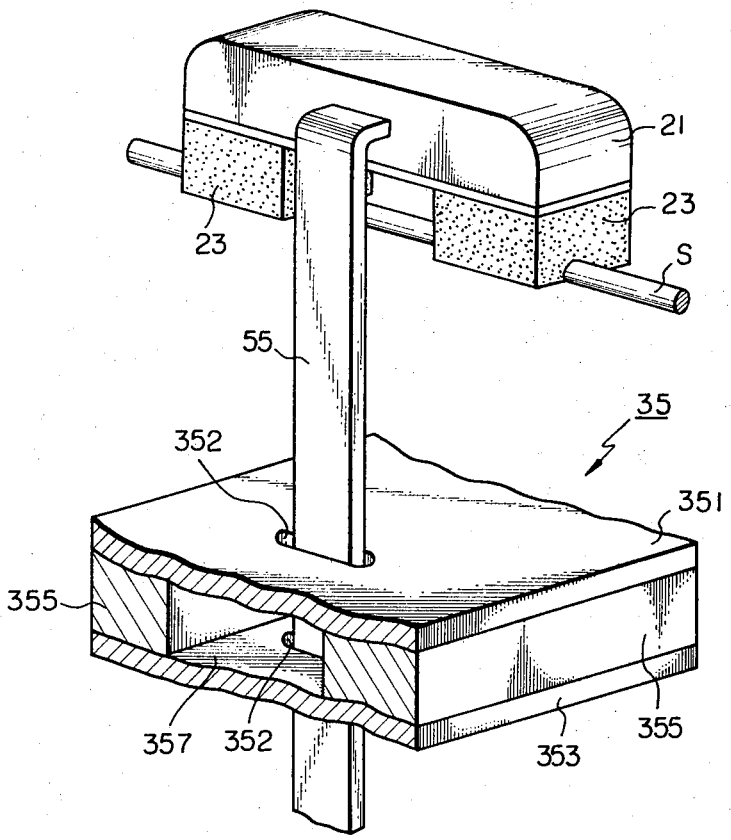
FIG. 4 is an enlarged fragmentary perspective view of the main part, i.e. the damper guide block, of the damper assembly shown in FIG. 3.

As seen in FIG. 4, the damper guide block 35 is comprised of an upper horizontal plate 351 extending over the entire width of the keyboard, a like lower horizontal plate 353 and a pair of front and rear spacers 355 interposed between the plates 351 and 353. The pair of spacers 355 are spaced from each other along the running direction of the strings S in order to leave an intermediate gap 357. At a position corresponding to each string S, the plates 353 and 355 are provided with through holes 359 in aligned collimation to each other.

A vertically extending damper holder 39 passes idly through the holes 359 and the gap 357 of the damper guide block 35 and carries the damper head at the top thereof in a manner similar to the prior art shown in FIG. 1.

In the case of this embodiment, the damper holder 39 is in the form of an elongated rod having a circular transverse cross section. A balance weight 41 is detachably fixed to the bottom end of the damper holder 39 by means of a set screw 43 and always rests on the damper spoon 31 of the key 1. Like the prior art, the balance weight 41 is preferably made of a heavy metal such as lead. At a position somewhat below the damper block 35, the damper holder 39 is fixedly provided with a tongue 45 which extends rearwards.

Like the conventional piano, a vertically extending sostenuto lift rod 47 is arranged on the rear side of the key 1 almost in parallel to the damper holder 39. The bottom end of the lift rod 47 is operationally linked to a damper pedal (not shown) arranged below the keyboard. The U-shaped top end 47*a* of the lift rod 47 rotatably carries a sostenuto rod 49 which extends horizontally over the entire width of the keyboard. A pair of fixed brackets 51 are arranged near both longitudinal ends of the sostenuto rod 49 and a hinge joint 53 is mounted atop each barcket 51. Each hinge joint 53 carries the associated end of the sostenuto rod 49 so that the sostenuto rod 49 is swingable about the hinge Q. The above-described rear tongue 45 of the damper holder 39 rests on the sostenuto rod 49. As a cushion for this contact, a felt sheet 45*a* may be advantageously attached to the bottom face of the rear tongue 45.

When the key 1 is not depressed, the damper assembly assumes the disposition shown in the drawing. That is, the damper head is placed in pressure contact with the associated string S, thereby free vibration of the latter being restrained.

As the key 1 is depressed during performance of the musical instrument, the damper spoon 31 of the key 1 thrusts up the balance weight 41 of the damper assembly and the damper head is brought out of pressure contact with the associated string S, thereby allowing free vibration of the latter for generation of the corresponding musical tone.

Upon removal of the pressure on the key 1, the entire damper assembly resumes the original disposition due to its weight, including the balance weight 41, and the damper head again comes into pressure contact with the vibrating string S in order to restrain further generation of the musical tone.

When the damper pedal (not shown) is stepped on by the player of the musical instrument, the sostenuto lift rod 47 moves upwardly so that the sostenuto rod 49 swings upwardly about the hinge Q. Then, the sostenuto rod 49 thrusts up rear tongues 45 of all damper holders 39 simultaneously and all strings S are liberated from pressure applied by the associated damper heads.

In order to minimize possible dancing of the damper holder 39 during the vertical movement, suitable felt rings may be inserted into the through holes 359 of the damper guide block 35.

When the above-described construction of the damper assembly is employed, the movement of the damper holder 39 is quite free of any undesired influence caused by swing of the cooperating mechanical part or parts such as the damper lever 11 used in the prior art shown in FIG. 1. Thus, undesirable deviation of the movement of the damper holder 39 from the true vertically can be greatly minimized in accordance with the present invention. As a result, the entire damper head can be brought into simultaneous and even pressure contact with the associated string, thereby successfully assuring enriched damping and acoustic effects. Further, approach to the true verticabity minimizes undesirable dancing of the damper holder during the movement and assures well controlled pressure contact of the damper head with the associated string.

Simply by loosening the set screw 43, the balance weight 41 can be removed from the damper holder 39, thereby enabling easy replacement of the balance weight and free adjustment of the weight of the damper assembly, i.e. touch on the key and damping on the string. More preferably, the bottom end of the damper holder 39 may be provided with several holes oriented in a vertical direction each receptive of a set screw for fastening the balance weight 41 to the damper holder. By changing the relative vertical position of the balance weight 41 with respect to the damper holder 39, the mode of contact of the balance weight 41 with the damper spoon 31 can be adjusted variously in order to control the touch on the key 1.

Figure 3:
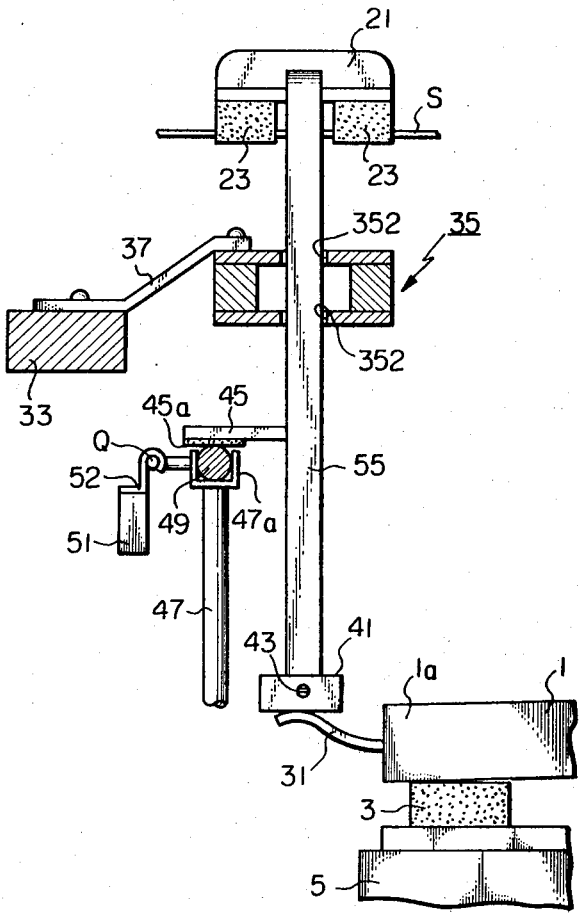
FIG. 3 is a side view, partly in section, of another embodiment of the damper assembly in accordance with the present invention.

In the above-described embodiment, the damper holder 39 takes the form of a rod having a circular transverse cross section. The second embodiment of the present invention is shown in FIG. 3, in which the damper holder has the form of a rigid plate-like rod that is non-circular in cross section. In FIGS. 3 and 4, mechanical parts similar in construction and operation to those used in the first embodiment are assigned like reference symbols. As well seen in FIG. 4, the damper holder 55 used in this embodiment is in the form of a rigid strip which idly passes through the damper guide block 35. As a substitute for the circular through holes 359 in the first embodiment, slots 352 are formed through the upper and lower horizontal plates 351 and 353 which extend in the string direction. The damper holder 55 extends vertically while idly passing through the slots 352. The slots 352 may preferably be accompanied by oblong felt rings surrounding the damper holder 55 for stable movement of the latter.

Since the coupling of the damper holder 55 in the form of a strip with the slots 352 of the damper guide block 35 effectively resists twisting of the damper holder 55 when the damper head comes in contact with the vibrating string S, undesirable deviated contact of the damper head with the string S can be successfully avoided, thereby ideally enhancing the damping and acoustic effects.

In the above-described two embodiments of the invention, the undesired influence caused by swinging movement of a mechanical part or parts is appreciably obviated. However, there still remains some problem regarding the operational relationship between the damper assembly and the key. This operational relationship is embodied by contact of the balance weight 41 with the damper spoon 31 at the rear end of the key 1. As the key 1 is depressed, the damper spoon 31 swings vertically with the rear end portion 1*a* of the key 1 and the rear end of the damper spoon 31 moves along an arcuate locus. Through the sliding contact with the balance weight 41 at the bottom of the damper holder 39 or 55, the above-described swinging movement of the damper spoon 31 may give rise to disorder in movement of the damper assembly and deviation from true verticality may occur.

Figure 5:
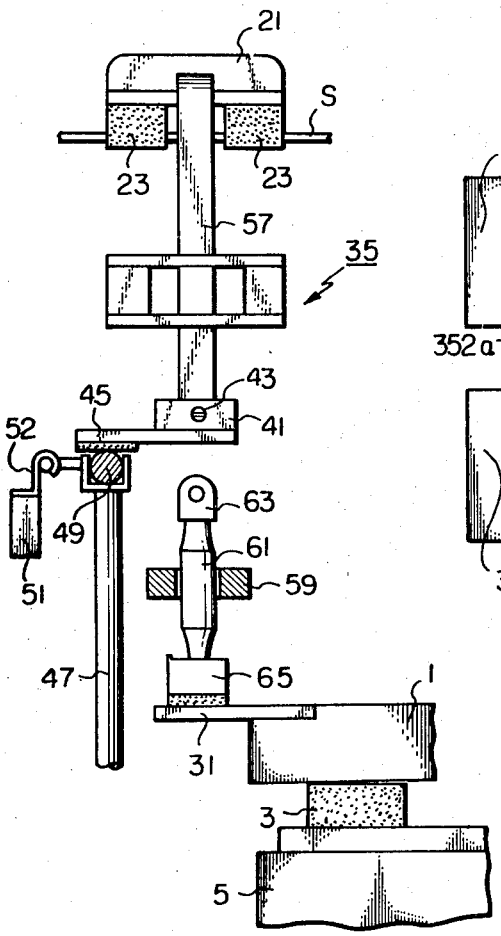
FIG. 5 is a side view, partly in section, of the other embodiment of the damper assembly in accordance with the present invention.

The third embodiment of the present invention shown in FIG. 5 contemplates elimination of such undesired influences caused by the swinging movement of the damper spoon 31. In the drawing, mechanical parts similar in construction and operation to those used in the foregoing embodiments are designated with common reference symbols. In this embodiment, the damper guide rail 33 and the arm 37 for supporting the damper block 35 are omitted and the damper block 35 is fixed on both longitudinal ends to the framework (not shown) of the musical instrument. A damper holder 57 used in this embodiment is also has the form of a rigid strip which is shorter than the damper holder 55 used in the foregoing embodiment. The balance weight 41 is detachably fixed to the bottom end of the damper holder 57 by means of the set screw 43, and the rear tongue 45 is fixed to the bottom of the balance weight 41.

A guide rail 59 is arranged somewhat below the rear tongue 45 while extending over the entire width of the keyboard. A vertical rod 61 passes through the guide rail 59 in slidable fashion. This vertical rod 61 is provided with an upper thrust piece 63 fixed to its top end and a lower seat piece 65 fixed to its bottom end. In the disposition shown in the drawing, i.e. when the key 1 is not depressed, the upper thrust piece 63 is spaced from the bottom of the rear tongue 45 and the lower seat piece 65 rests on the damper spoon 31 which, in this embodiment, extends almost horizontally.

As the key 1 is depressed, the damper spoon 31 swings upwards in order to thrust up the vertical rod 61 and its related parts. In this case, the movement of the vertical rod 61 and its related parts is highly close to true verticality since the vertical rod 61 is guided by the guide rail 59. Thus, the thrust piece 63 almost vertically pushes up the damper holder 57 via the rear tongue 45 so that the damper head is brought out of the pressure contact with the string S for free vibration of the latter. Upon removal of the pressure on the key 1, the damper spoon 31 swings downwards and the vertical rod 61 and its related parts resume their original state due to their own weight. Concurrently with this process, the damper holder 57 and its related parts resume their original state due to their own weight so that the damper head is again brought into pressure contact with the vibrating string S in order to restrain further free vibration.

Due to use of the intermediate rod 61 whose movement is guided by the rail 59, undesired influence caused by the inevitable swinging movement of the damper spoon can be successfully obviated.

Figure 6:
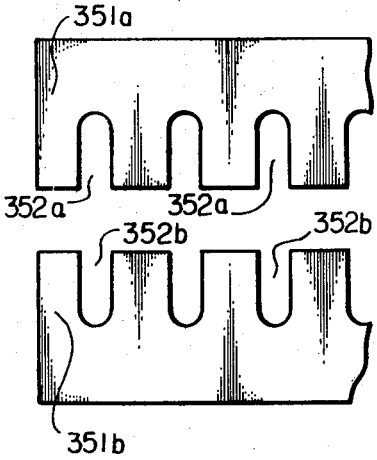
FIG. 6 is a plan view of the plate or strip usable for the damper guide block shown in FIG. 4.

FIG. 6 depicts a modification of the embodiments shown in FIGS. 3 and 5 in which slots are used in order to guide the vertical movement of the plate-type damper holder 55 or 57. For example, the upper plate 351 is made up of a pair of plate pieces **351*a* and 351*b* which are to be coupled in a front and rear relationship in use. Opening on the mating edges, like slot halves 352*a* and 352*b* are formed in the plate piece 351*a* and 351*b*. When the plate pieces 351*a* and 351*b* are coupled together along the mating fringes, the combined slot halves 352*a* and 352*b* form a complete slot 352**.

We claim:

1. An improved damper assembly for a keyboard musical instrument comprising a vertically extending damper holder having a free bottom end which is operable by an associated key, said damper holder having one longitudinal section which is non-circular in traverse cross section, a damper head mounted on said damper holder and facing an associated string for being engagable with the string, and a fixed damper block arranged below said associated string and being provided with a respective vertical opening for said damper holder, through which said one longitudinal section of said damper holder is movable, said one vertical opening being similar in cross section to said longitudinal section of said damper holder.

2. An improved damper assembly as claimed in claim 1, further comprising means for operationally coupling said bottom end of said damper holder to the associated key in such a manner as to thrust said damper holder upwardly when the associated key is depressed, said operational coupling means including a fixed guide rail between said damper block and the rear end of the associated key, a vertically extending rod slidably passing through said guide rail, a thrust piece mounted atop said rod and facing said bottom free end of said damper holder, and a seat piece disposed to the bottom of said rod and resting on said rear end of said associated key.

3. An improved damper assembly as claimed in either of claims 1 or 2 in which said damper holder comprises a rigid strip.

4. An improved damper assembly as claimed in either of claims 1 or 2 in which said free bottom end of said damper holder terminates in a detachable balance weight.

5. An improved damper assembly as claimed in claim 4 in which said balance weight is provided with at least a hole receptive of said bottom end of said damper holder, and means for releasably fixing said bottom end of said damper holder in said hole.

6. An improved damper assembly as claimed in either of claims 1 or 2, wherein said damper block is comprised of a pair of mutually combined block halves, each said block half having a mating edge running substantially at a right angle to the string direction of extension, each said block half is provided with an opening half opening on its mating edge, and a corresponding pair of said opening halves in different said block halves being oriented and positioned to form said vertical opening for enabling the passing of said longitudinal section of said damper holder therethrough when said block halves are combined to form said damper block.

* * * * *